US006508171B1

(12) United States Patent
Georges

(10) Patent No.: US 6,508,171 B1
(45) Date of Patent: Jan. 21, 2003

(54) ILLUMINATED TRANSPARENT ARTICLE HAVING A SEMI-TRANSPARENT IMAGE THEREON

(76) Inventor: Chris Georges, 35 Orange St. Apt. 5C, Brooklyn, NY (US) 11201

( * ) Notice: Subject to any disclaimer, the term of this patent is extended or adjusted under 35 U.S.C. 154(b) by 29 days.

(21) Appl. No.: 09/632,062

(22) Filed: Aug. 3, 2000

(51) Int. Cl.[7] ..... B41C 1/00
(52) U.S. Cl. ..... 101/483; 40/716; 283/110
(58) Field of Search ..... 101/33, 34, 483, 101/491, 492; 40/714, 715, 716; 283/94, 107, 110

(56) References Cited

U.S. PATENT DOCUMENTS

| | | | | | |
|---|---|---|---|---|---|
| 1,280,655 | A | | 10/1918 | Briggs | |
| 1,660,346 | A | | 2/1928 | Neal | |
| 2,043,865 | A | | 6/1936 | Place | |
| D230,700 | S | | 3/1974 | Rochford | |
| D243,918 | S | | 4/1977 | Creamer | |
| 4,263,061 | A | * | 4/1981 | Fatuzzo et al. | 148/276 |
| 4,354,851 | A | | 10/1982 | Hix et al. | |
| 4,355,198 | A | | 10/1982 | Gartland, Jr. | |
| 4,406,662 | A | | 9/1983 | Beran et al. | |
| 4,510,225 | A | * | 4/1985 | Kuehnle et al. | 428/203 |
| 4,934,792 | A | * | 6/1990 | Tovi | 350/320 |
| 5,031,525 | A | | 7/1991 | Kent et al. | |
| 5,142,722 | A | | 9/1992 | Kolb | |
| 5,296,081 | A | | 3/1994 | Morin et al. | |
| 5,455,129 | A | * | 10/1995 | Bussard | 101/129 |
| 5,492,370 | A | * | 2/1996 | Chatwin et al. | 283/107 |
| 5,546,687 | A | * | 8/1996 | Iorfida | 362/128 |
| 5,724,891 | A | * | 3/1998 | Lovison | 101/174 |
| 5,824,116 | A | | 10/1998 | Zutler | |
| 5,829,177 | A | * | 11/1998 | Hjaltason | 362/812 |
| 5,925,437 | A | * | 7/1999 | Nelson | 156/252 |
| 6,240,664 | B1 | * | 6/2001 | Hjaltason | 362/812 |
| 6,264,782 | B1 | * | 7/2001 | Oshima et al. | 156/235 |
| 6,316,082 | B1 | * | 11/2001 | Tomkins et al. | 283/100 |

* cited by examiner

*Primary Examiner*—Ren Yan
(74) *Attorney, Agent, or Firm*—William J. Sapone; Coleman Sudol Sapone, P.C.

(57) ABSTRACT

An article is produced that utilizes a transparent substrate having a dye sublimation image incorporated preferably into a rear surface thereof. A light reflective coating is applied to the rear surface so that the image is evenly illuminated by a light source located behind the substrate, the image when illuminated having striking depth and clarity. The method for producing the imaged transparent substrate uses a minimum number of steps to provide a low cost high quality article.

9 Claims, 3 Drawing Sheets

ILLUMINATED TRANSPARENT ARTICLE HAVING A SEMI-TRANSPARENT IMAGE THEREON

TECHNICAL FIELD

This invention relates to transparent plastic articles such as light shades that contain a semi-transparent dye sublimation image preferably printed on a back surface thereof.

BACKGROUND

Various techniques are known for printing images on articles. For example, in U.S. Pat. No. 5,142,722, a process for applying images by transfer printing to furniture is described.

Heat transfer printing utilizes a heat transfer print sheet containing an ink image capable of transfer upon application of heat and pressure to a substrate usually containing a receptive coating layer.

In U.S. Pat. Nos. 4,059,471 and 4,465,728, plastic products receive a heat transfer image by using a polyolefin film between the dye transfer paper and a sheet of thermoplastic to avoid transfer of dye adhesive or carrier.

In U.S. Pat. No. 4,395,363, a process for applying an image using sublimation inks to a surface not normally receptive to such inks is disclosed. A primer coat which readily adheres to the surface is used with a binder layer adhered thereover. A clear layer or coating is applied, the layers being thermosetting and cured prior to receiving a dye sublimation ink transfer image.

Typically multiple layers are necessary to apply an image to an article, increasing cost and complexity. Further, care must be taken with plastics to avoid damage through the heat and pressure used in a heat transfer printing process.

The placement of images on a transparent article has several specific requirements. Distortion must be limited and image transfer must be exact, even and avoid bleeding of the dyes. High quality image transfer to transparent plastics and glass has not yet been satisfactorily achieved.

SUMMARY OF THE INVENTION

It is an object of the present invention to provide a method for transferring an image to a transparent article with a minimum number of steps.

It is a further object to provide high quality images on a transparent substrate at low cost.

It is a further object to provide a dye sublimation image on a transparent plastic or glass substrate with high clarity, definition and intensity so as to create an illuminable image.

It is yet another object to provide a transparent shade for a light fixture containing a semi-transparent image.

These and other objects of the present invention are achieved by a method for transferring a sublimation dye image to a transparent substrate comprising: providing a transparent substrate having a front surface and a rear surface; providing an image composed of transferable dyes; placing the image in contact with a surface of the substrate; transferring the dye image onto the substrate; and applying a light reflective coating to the rear surface of the substrate.

Preferably, the image is transferred to the rear surface, with the light reflective coating applied thereover. This light reflective coating also is preferably capable of diffusing light transmitted therethrough when the article is back illuminated to enhance perception of the image when viewed from the front surface. The transparent article may be made of glass or plastic.

Various printing techniques can be used to transfer a dye image to the substrate such as direct screen printing and pad printing but dye sublimation transfer printing is preferred, because such dyes can infiltrate into a surface to some depth, altering the substrate itself.

The image itself is preferably produced from transparent or opaque inks so that it is semi-transparent so as to allow light transmission therethrough. Application of a light diffusing coating may be used to distribute light evenly so as to illuminate the entire image when a light is placed behind the article such that the image is in essence projected therefrom. Utilizing this method, a photograph or other artistic image can be transferred quickly and cheaply to transparent plastic and when illuminated, provide a back illumination of the image which is particularly striking in clarity and quality.

BRIEF DESCRIPTION OF THE DRAWINGS

The invention will now be described in more detail with reference to the drawing, where.

DETAILED DESCRIPTION OF THE INVENTION

The present invention is directed to the incorporation of a dye image preferably to a back side of a transparent or translucent plastic or glass substrate so as to enable back illumination of the image. The dye used is preferably a transparent or semi-transparent opaque ink. The image preferably has an increased dye density so as to increase the depth and clarity of the image when viewed from the front. A light reflecting/diffusing coating is preferably applied to the back side of the substrate so as to provide a reflective base as well as to spread light across the rear surface to back illuminate the entire image.

For purposes of this application, the term "image" means any reproduction or imitation of the form of a person, object, scene, logo, or artistic representation. It could take the form of any graphical representation, such as a logo, stylized text, artwork, photograph, animation, etc., and should be taken to include any image that can be transferred in accordance with the present invention. Thus, the term "image" is not limited by its content.

Figure 1:
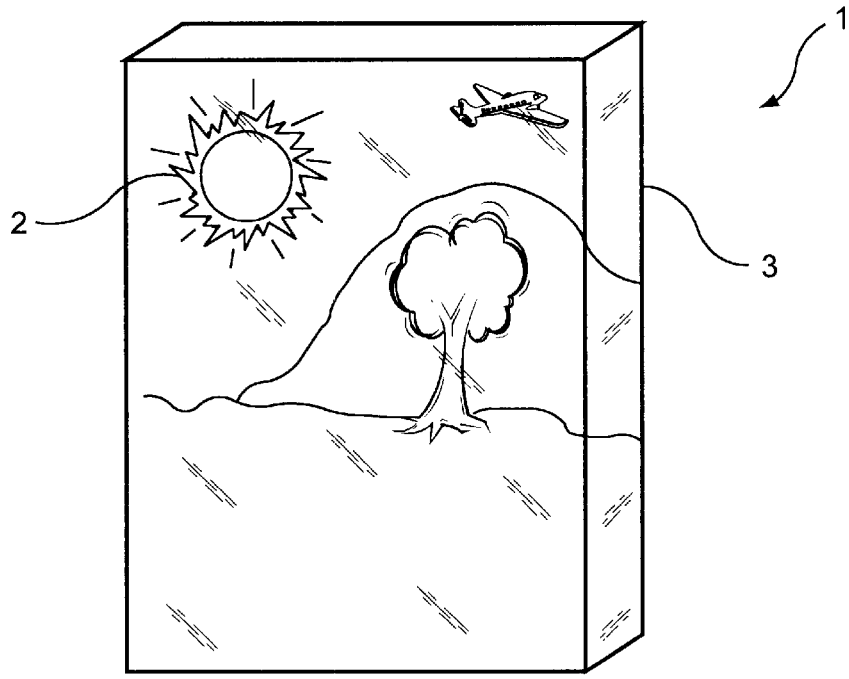
FIG. 1 is a view of an imaged transparent plastic sheet.

FIG. 1 shows a transparent plastic sheet 1 containing an image 2 on the rear surface 3 thereof.

The transparent substrate can be made of glass or plastic of many types such as acrylic, particularly those polymers incorporating a methyl methacrylate monomer, which are excellent for transparency, though any type of light transmissive polymer such as fluorine, polyester, polycarbonate, polyether terephthalate, etc., may be used. However, it should be understood that light transparency need not be 100%, as some light may be absorbed at the time of transmission. Therefore, the substrate can be frosted, textured, colored, stained or semi-transparent so as to allow some light transfer therethrough. If plastic, the article can be shaped prior to or after transfer, though transfer to a flat sheet is easiest to accomplish.

The image is transferred preferably according to a sublimation dye transfer process using a transfer sheet impregnated with a sublimatable dye in a selected image. The dyes chosen utilize preferably transparent inks to produce the semi-transparent image in the substrate.

Virtually any image can be printed on the transfer sheet up to and including photographic quality images. The above invention would allow one, for example, to select personal photographs for incorporation for example onto a transparent plastic sheet which can be framed and back lit for display. The amount of dye used is sufficient to infiltrate into the substrate yet not so dense as to block light transmission. Rather the amount is sufficient to be semi-transparent so as to fully project the image when back lit. However, to provide the proper depth, increased density of 10–25% over the typical dye density is preferred.

Generally speaking density is the ability of a material to absorb or transmit light. It does not refer to color. Density is calculated by densitometers using the equation:

$$\text{Density}=\log 10\ 1/R$$

(where R is reflectance)

For simplicity relating to ink densities in printing, a numeric value of 3.0 is a highly dense/dark area, where a value of 0.40 would be a highly reflective light area comprised of a very thin deposit of ink. Offset printing of four color process dye sublimation inks usually covers the density range of 0.40–0.90 for the process colors cyan, magenta and yellow (CMY, K=Black). Different substrates dictate different densities as well as other variables such as quality of sublimatable dyes in the inks and imaging transfer procedure. For the purpose of illustration as it relates to transparent and translucent substrates, the following adjustment is preferably made in density. Normal density when transferring directly to a white solid surfaces such as wood or metal would be a density of about 0.60 to 0.70. Density is adjusted when transferring to transparent or translucent substrates to obtain a density of about 0.70–0.90. This represents an increase of approximately 25% in density from normal values. Obviously the specific values will vary depending on CMYK composition in each respective image. Although not certain, it appears that an increase of 10 to 30% in density counters the diffusion of the light reflected back through the substrate as the substrate creates visual interference when viewing. Also, light entering from the sides of the substrate could lighten the image and further be counteracted by the increased density of the image.

While imaging on the front surface is possible, imaging the rear surface provides several advantages. The image has more depth when illuminated yet is not quite visible when not illuminated to create a striking effect when the light is turned on. This is quite different from front painted plastics where the image is fully visible whether illuminated or not. These appear to lack quality in presentation and also subject the image to wear and tear.

Alternatively, an image can be transferred via the dye sublimation process to the front side of a transparent or translucent substrate. Although it creates satisfactory results, the imaging process lacks somewhat the detail and clarity achieved via backside imaging. This is believed due to the thickness of the substrate. The thicker the substrate is, the greater the diffusion of light, hence, the greater the distortion to the perceived image. As the distance between the imaged transfer layer and the white or light colored foundation layer increases, the more detrimental the affect in diffusing the image. The more intimate these 2 layers can be, the better the quality. With this in mind, front surface imaging should be limited to relatively thin substrates, preferably being about ¼" thick or less.

Figure 2:
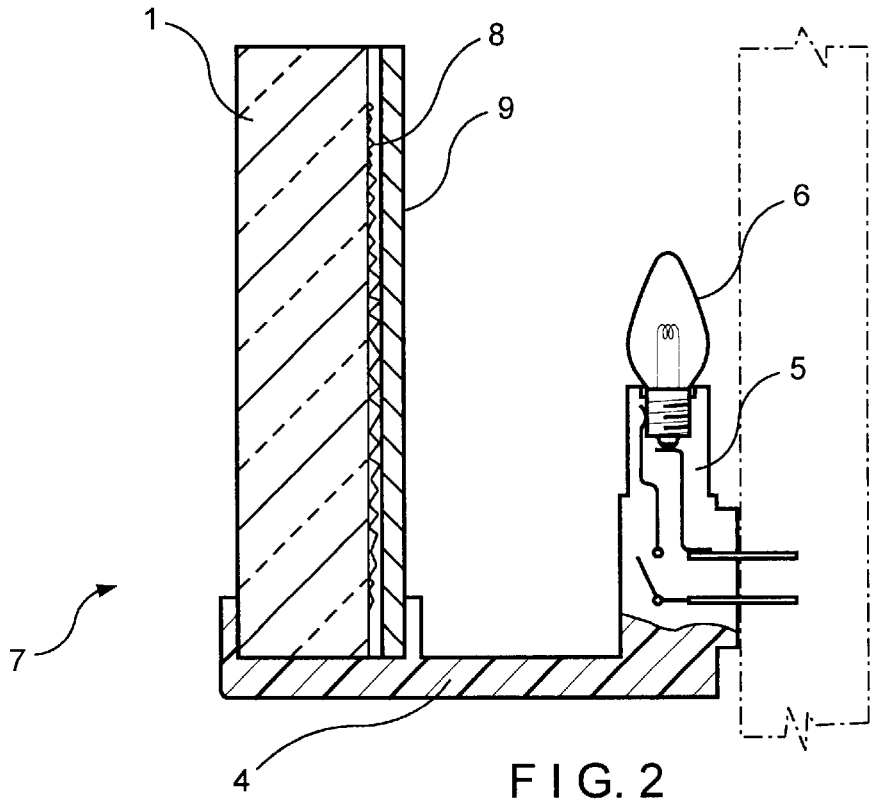
FIG. 2 is a cross-sectional view of a night light having a shade produced according to the present invention.

FIG. 2 shows the sheet 1, mounted on an arm 4 that is integral with a receptacle 5 that receives a light bulb 6, forming a night light assembly 7. In cross section, the inks 8 are discernable, but the image itself is not. A coating 9 is applied to the rear surface to reflect and/or diffuse light transmitted through the coating. The coating may be white or colored to tint the image, and applied by spray, brush, screen printing or laminate application. This also creates a reflective foundation for the transparent inks for light entering from the front surface which reflects back through the image.

Figure 3:
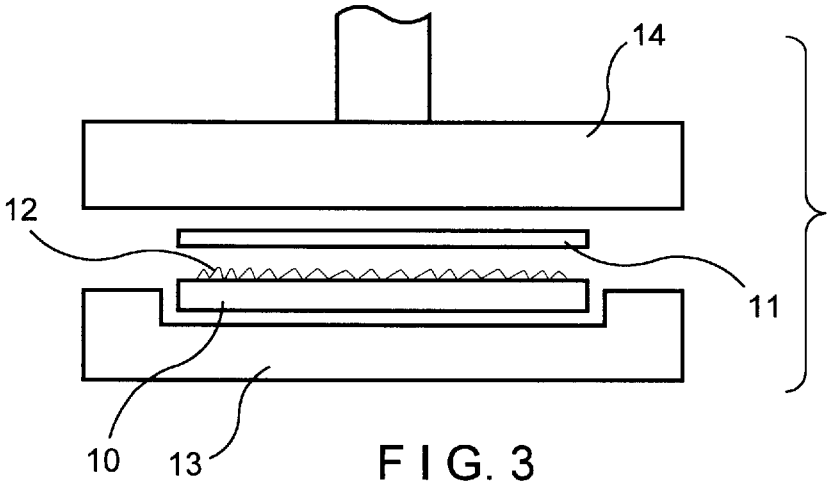
FIG. 3 is an exploded view illustrating the image transfer process.

An article produced in accordance with the present invention may be produced as follows, by way of example with reference to FIG. 3, though the invention is not limited to the details or materials disclosed, as would be understood by one skilled in the art.

A flat acrylic sheet is cut to produce an article 10 measuring 4"×5". The edges are made smooth and the corners rounded.

A dye sublimation transfer 11 is prepared according to conventional practice containing a selected image, the transfer printed in the right reading direction, as opposed to the common practice of producing a mirror image transfer. This is done because the image will be applied to a rear surface for viewing through the transparent article. In addition, the ink densities are increased by 25% to promote depth distribution into the substrate, which results in image enhancement when lighted. The plastic accepts the transparent sublimation dye which diffuse into the plastic sheet.

Optionally, a 2–3 mil coating 12 of a dye receptive polymer can be applied prior to transfer, which is particularly useful when the substrate is glass. While not necessary, a dye receptive coating promotes rapid transfer of the dye via sublimation reducing the time the plastic is subject to the transfer heat and pressure. For example, using the 2–3 mil coating allows transfer at a pressure of about 10–12 psi, temperature of about 410° F., in about 30–40 seconds. The same transfer, without the coating could take about 90–120 seconds.

Suitable materials for use in the dye receptive layer include known resins which can be dyed with sublimitable dyes. Specific examples of such resins include polyolefin such as polypropylene; halogenated polymers such as polyvinyl chloride and polyvinylidene chloride, vinyl polymers such as polyvinyl acetate and polyacrylates; polyester resins such as polyethylene terephthalate and polybutylene terephthalate; polystyrene resins; polyamide resins; cellulose resins; and polycarbonate resins.

The article 10 is placed in a holding tool 13 and the transfer paper 11 placed in contact with the rear surface. A heated thermally conductive press 14 then applies the selected heat and pressure so as to effect transfer of the image as the dye moves from the paper and diffuses into the plastic.

The heated thermally conductive press is then removed and the sheet 10 cooled.

Optionally, the sheet can be shaped or treated with pressure to correct any deformation of the plastic that occurred during the transfer process. For example, the sheet may be curved for use as a shade on a night light at this point.

After cooling, a light reflective coating is applied to the rear surface to complete the imaging process and the plate is then ready for further conventional processing into the end use article. For example, if a night light is desired, the conventional steps would include, for example, adding a means for attachment to a night light fixture and packaging for sale.

Of course, the invention is not limited to night lights and virtually any product currently or in the future which could incorporate a back lighted image could utilize the present invention.

Figure 4:
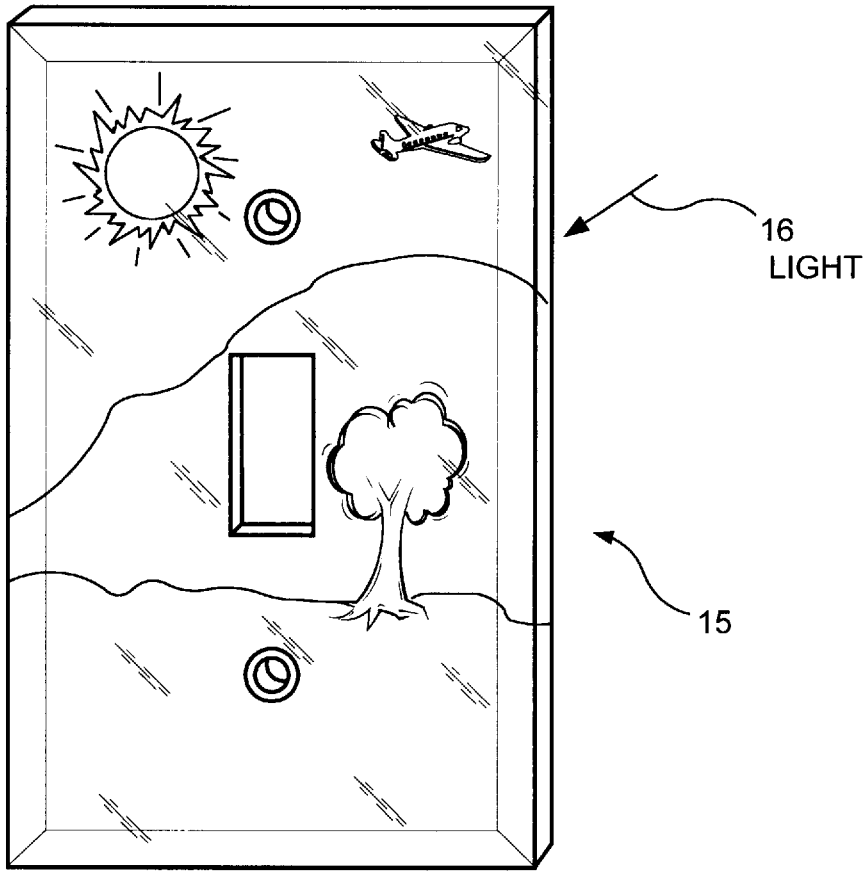
FIG. 4 is a view of an imaged wall plate.

One novel product in accordance with the present invention is a decorative electrical wall plate 15, as shown in FIG. 4. These are commonly produced of plastic and have been known in the past to contain face images. However, neither the use of transparent plastic nor back lighting of such wall plates is believed to be known. The invention utilizes a transparent plastic for forming the wall plate 15, imaging in accordance with the present invention and incorporation of a light source illustrated by arrow 16 behind the wall plate to, for example, illuminate the switch location when a light switch is in the off position. This provides aesthetic benefits to a room and at the same time provides the function of illuminating a switch location.

Figure 5A:
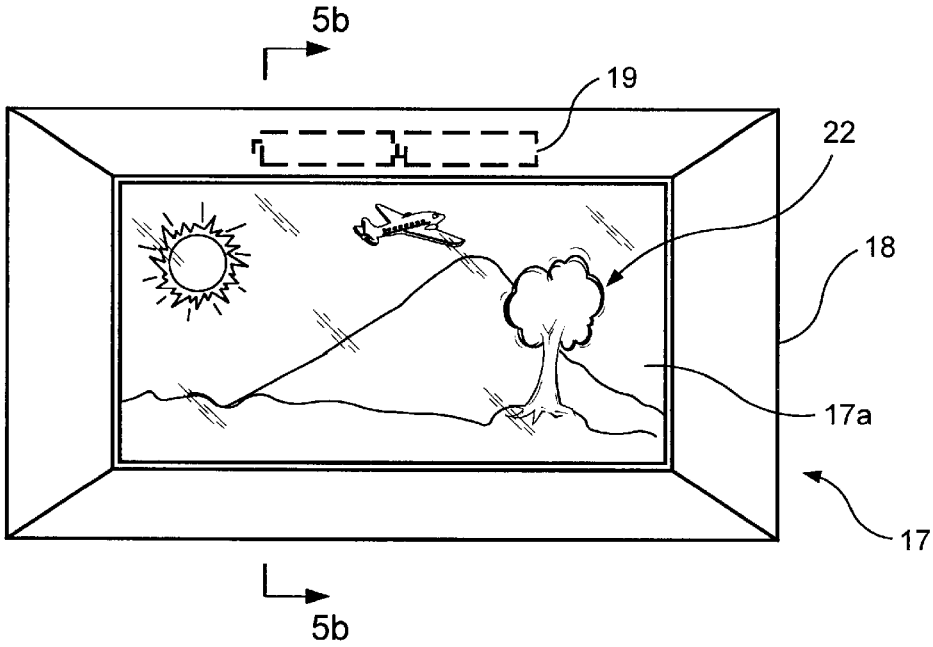
FIG. 5*a* is a front view of a picture frame.

Another use can be of a stand alone picture frame 17 as shown in FIG. 5*a* containing an illuminated personal photograph 17*a* that is readily imaged onto a photographic sized acrylic sheet. A frame 18 containing a power source 19, a light source 20 and a switch 21 can be used to display a particular image 22 to enhance depth and clarity.

Figure 5B:
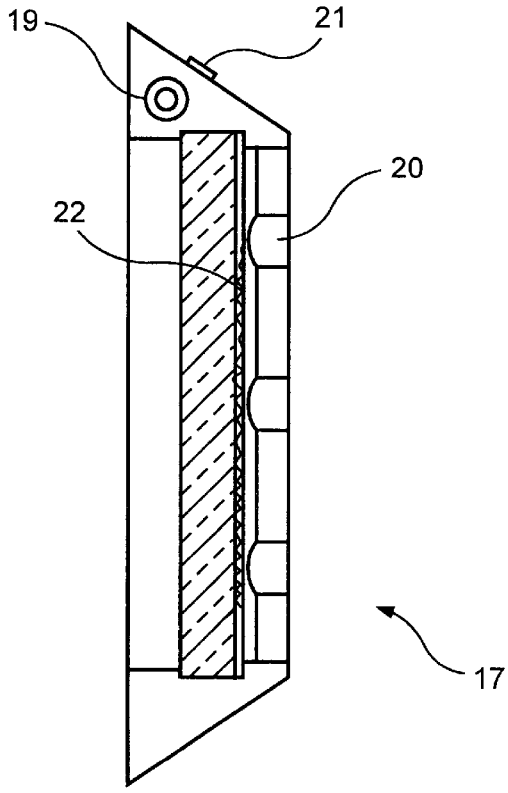
FIG. 5*b* is a cross-section thereof.

FIG. 5*b* shows in cross-section the components for back illumination using low power light emitting diodes 20, batteries 19 carried in the frame 18.

While preferred embodiments of the present invention have been shown and described, it will be understood by those skilled in the art that various changes or modifications can be made without varying from the scope of the invention.

I claim:

1. A method for producing a back illuminable transparent article having a dye image incorporated therein comprising:

providing a transparent substrate having a front surface and rear surface:

providing a transferable dye image formed of transparent or translucent ink;

placing the transferable dye image in contact with a surface of the substrate;

transferring the dye image to the surface;

applying a light reflective coating to the rear surface of the substrate to diffuse light into the substrate from the rear surface such that providing a light source adjacent the rear surface of the substrate illuminates the dye image from the rear surface thereof so as to project the image with depth and clarity from the front surface thereof.

2. The method of claim 1 wherein the transferrable dye image is a sublimation dye image.

3. The method of claim 1 wherein the image is transferred by applying heat and pressure to the transferrable dye image.

4. The method of claim 1 wherein the transparent substrate is made of glass or plastic.

5. The method of claim 1 further comprising placing the transferrable dye image in contact with the rear surface of the substrate.

6. The method of claim 1 further comprising placing the transferrable dye image in contact with the front surface of the substrate.

7. The method of claim 1 wherein the image is transferred by a printing process.

8. The method of claim 1 further comprising providing a transferrable dye image of high ink density.

9. The method of claim 8 wherein about a 10 to 30% increase in dye density is used.

* * * * *